US006994521B2

(12) United States Patent
Liang

(10) Patent No.: US 6,994,521 B2
(45) Date of Patent: Feb. 7, 2006

(54) LEADING EDGE DIFFUSION COOLING OF A TURBINE AIRFOIL FOR A GAS TURBINE ENGINE

(75) Inventor: George Liang, Palm City, FL (US)

(73) Assignee: Florida Turbine Technologies, Inc., Stuart, FL (US)

( * ) Notice: Subject to any disclaimer, the term of this patent is extended or adjusted under 35 U.S.C. 154(b) by 41 days.

(21) Appl. No.: 10/791,581

(22) Filed: Mar. 2, 2004

(65) Prior Publication Data

US 2005/0265838 A1 Dec. 1, 2005

Related U.S. Application Data

(60) Provisional application No. 60/454,121, filed on Mar. 12, 2003.

(51) Int. Cl.
*F01D 5/18* (2006.01)

(52) U.S. Cl. ..... 416/97 R

(58) Field of Classification Search ..... 416/90 R, 416/97 R; 415/115

See application file for complete search history.

(56) References Cited

U.S. PATENT DOCUMENTS 6,210,112 B1 * 4/2001 Tabbita et al. ..... 416/97 R
2002/0018717 A1 * 2/2002 Dailey ..... 416/97 R

* cited by examiner

*Primary Examiner*—Edward K. Look
*Assistant Examiner*—Richard A Edgar
(74) *Attorney, Agent, or Firm*—Norman Friedland

(57) ABSTRACT

A plurality of double rows of orifices sandwiching a plenum formed in the wall of the leading edge of an airfoil diffuses the coolant that feeds a plurality of columns and rows of grooves formed in the leading edge of the airfoil so as to diffuse the coolant and define a film of cooling air. The grooves may be aligned or staggered and the orifices, plenums and grooves are sized to match the airflow to the heat load along the leading edge to maximize the use of coolant and enhances engine performance as does the absence of material at the leading edge that results from the use of the columns and rows of grooves.

16 Claims, 2 Drawing Sheets

LEADING EDGE DIFFUSION COOLING OF A TURBINE AIRFOIL FOR A GAS TURBINE ENGINE

CROSS-REFERENCE TO RELATED APPLICATION

This application claims benefit of a prior filed now abandoned U.S. provisional application Ser. No. 60/454,121, filed on Mar. 12, 2003, entitled MULTI-METERING DIFFUSION COOLING TECHNIQUE by George Liang.

This patent application relates to the contemporaneously filed patent application entitled VORTEX COOLING FOR TURBINE BLADES by the same inventor and commonly assigned to Florida Turbine Technologies, Inc., inasmuch as both inventions relate to cooled turbine blades and both inventions can be utilized together. This application is incorporated herein by reference.

STATEMENT REGARDING FEDERALLY SPONSORED RESEARCH OR DEVELOPMENT

None

TECHNICAL FIELD

This invention relates to air cooled turbines for gas turbine engines and particularly to cooling of the leading edge of the turbine blade.

BACKGROUND OF THE INVENTION

This invention constitutes an improvement over U.S. Pat. No. 5,486,093 granted to Auxier et al on Jan. 23, 1996 entitled LEADING EDGE COOLING OF TURBINE AIRFOILS. This patent teaches the use of helix shaped cooing passages in the leading edge of the turbine blade so as to enhance convective efficiency of the cooling air and to improve discharge of the film cooling air by orienting the discharge angle so that the discharging air is delivered more closely to the pressure and suction surfaces. The helix holes place the coolant closer to the outer surface of the blade to more effectively reduce the average conductive length of the passage so as to improve the convective efficiency. Also higher heat transfer coefficients are produced on the outer diameter of helix holes improving the capacity of the heat sink. This patent is incorporated herein by reference.

U.S. Pat. No. 4,180,373 granted to Moore et al on Dec. 25, 1979 and entitled TURBINE BLADE, U.S. Pat. No. 5,356,265 granted to Kercher on Oct. 18, 1994 entitled CHORDED BIFURCATED TURBINE BLADE, U.S. Pat. No. 5,967,752 granted to Lee et al on Oct. 19, 1999, and U.S. Pat. No. 5,538,394 granted to Inomata et al on Jul. 23, 1996 exemplify traditional techniques for cooling the airfoil leading edge. In the teachings of these patents, the airfoil leading edge is cooled with backside impingement in conjunction with showerhead film cooling. Showerhead film cooling holes formed in rows spanning the leading edge along the radial and chord-wise axis are fed coolant from a common mid-chord cavity so as to direct impingement air on the back wall of the leading edge and feed the film cooling holes. The coolant discharges from the blade at various pressures of the engine working medium that is adjacent the discharge of the film cooling hole. As a result of this cooling approach, cooling flow distribution and pressure ratio across the showerhead film holes for the pressure side and suction side is predetermined by mid-chord cavity pressure. This condition is more clearly shown in FIG. 4 which is a graph plotting the airflow of the air extending a distance spanning the suction side to the pressure side. Since the pressure of the engine working fluid closer to the suction side of the blade is less than the pressure adjacent to the pressure side as the coolant flows through the rows of blade spanning the leading edge from the suction side to the pressure side, there is a drop off of airflow as represented by the solid line in FIG. 4.

In addition, the conventional film cooling holes pass straight through the airfoil wall at a constant diameter and exit at an angle to the exterior surface. Some of the coolant is subsequently injected directly into the mainstream causing turbulence, coolant dilution and loss of downstream film cooling effectiveness. Furthermore, film cooling hole breakout on the airfoil surface may induce stress problems. For further details of the operation of shower head cooling for turbine blades reference should be made to U.S. Pat. Nos. 4,180,373, 5,356,265, 5,967,752 and 5,538,394, supra, all of which are incorporated herein by reference.

This invention not only serves to alleviate the problems noted in the above paragraph, but provides cooling with a lesser amount of cooling air which improves the efficiency of the turbine an adds to the performanc of the engine. In accordance with this invention, the leading edge is cooled by film cooling by first diffusing the coolant before being discharged out of the blade. The diffusion is accomplished by controlling the pressure ratio across the film cooling hole by first passing the coolant through a first restriction and then a second restriction to obtain the desired pressure and then discharging the coolant into an elongated chamber formed on the outer surface of the leading edge. The restrictions are located upstream of a plenum chamber where the coolant is diffused and ultimately into an elongated chamber or pocket formed on the exterior wall of the leading edge. These chambers are arranged in an array of parallel spaced columns and rows thereof extend along the leading edge and may be aligned in the chord-wise direction or stepped radially. These pockets have a twofold purpose, namely 1) they provide an insulation blanket of cooled air to cool the surface of the leading edge and 2) they remove the metal surface of the leading edge and hence the path of heat conductivity is lessened.

SUMMARY OF THE INVENTION

An object of this invention is to provide for a turbine of a gas turbine engine improved cooling of the leading edge.

A feature of this invention is the provision of diffusion means extending between the mid-chord cavity that feeds coolant to the leading edge where the diffusion means includes a first metering orifice causing a pressure drop and a first plenum and a second metering orifice causing an additional pressure drop and a second plenum which is an elongated slot or groove formed on the surface of the leading edge. An array of a plurality of grooves extend and spaced longitudinally and extend and spaced chord-wise and are parallel in the longitudinal direction and may be aligned or stepped in the chord-wise direction.

Another feature of this invention is the provision of grooves formed in columns and rows in the leading edge of a turbine and controlling the flow into the grooves by first passing the coolant through a first restriction and plenum and then through a second restriction before flowing into the grooves and sizing the restrictions and plenums in each of the columns to maintain a controlled air flow along the chord-wise direction of the leading edge so that the airflow is generally constant. The dimensions of each of the grooves, plenums and restrictions can be selected so that the air flow to each section of the leading edge in both the longitudinal and chord-wise directions matches the localized heat at each of these sections of the airfoil.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While this invention is being described showing a particular configured turbine blade as being the preferred embodiment, as one skilled in this art will appreciate, the principals of this invention can be applied to any other turbine blade that requires internal cooling and could be applied to vanes as well.

Figure 1:
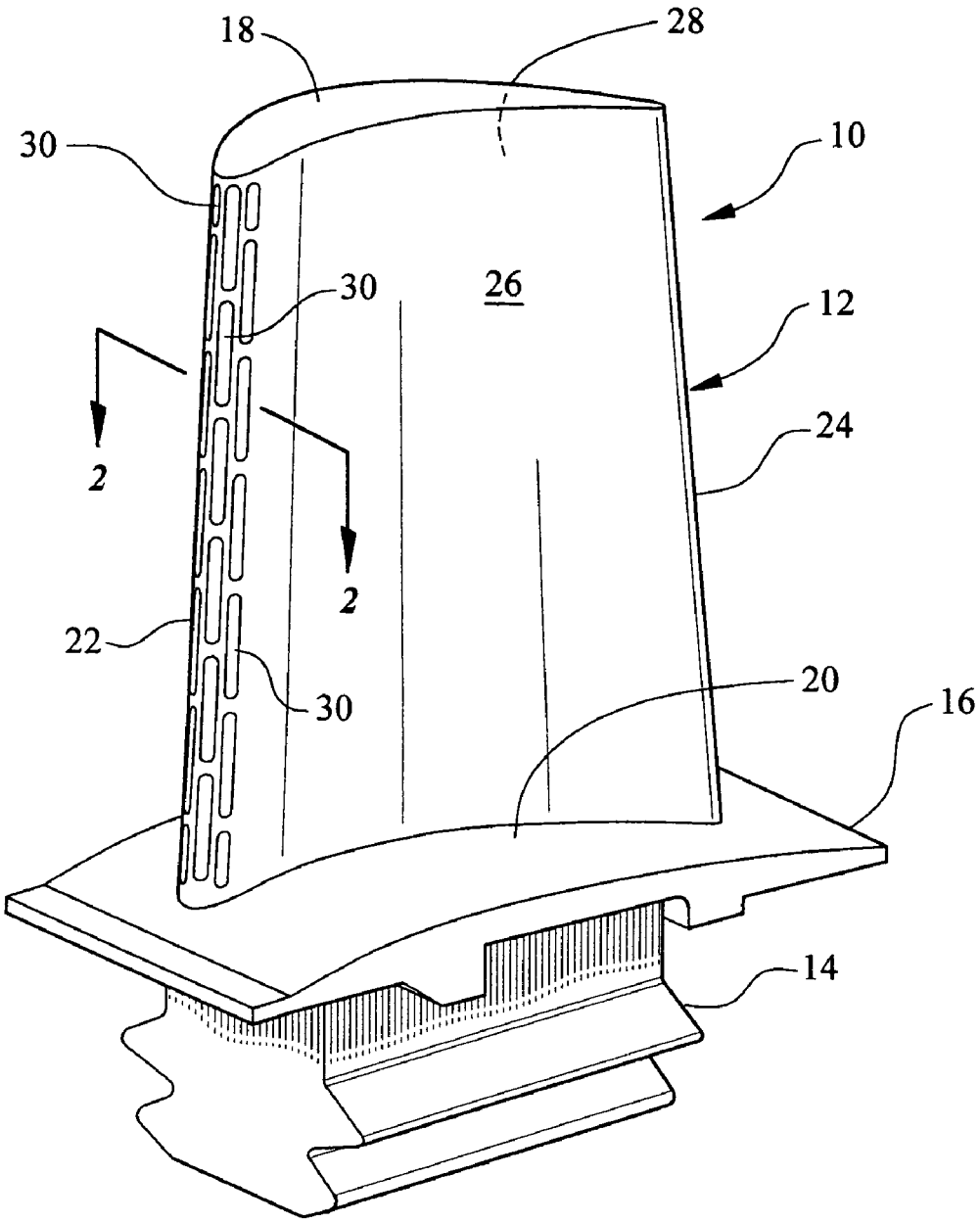
FIG. 1 is a perspective view illustrating a turbine blade for a gas turbine engine made in accordance with this invention.

Reference is now being made to FIG. 1 which illustrates a typical turbine blade for a gas turbine engine generally indicated by reference numeral 10 as comprising an airfoil section 12 and a fir-tree attachment 14 including a platform 16. The airfoil consists of the tip 18, the root 20, the leading edge 22, the trailing edge 24, the pressure side 26 and the suction side 28. A plurality of grooves or pockets 30 forming an array of columns and rows are disposed on the leading edge 22 and these grooves 30 form a portion of this invention and will be described in detail herein below. For the moment, suffice it to say that while the column of grooves extend from the root of the blade toward the tip 18 and the rows extend along the chord-wise direction from the pressure side 22 to the suction side 24 and are staggered in the column and row directions, the array may take any other patterns which will be predicated on the particular engine application. For example, the grooves 30 may be aligned in either the chord-wise direction or the longitudinal direction or both. Likewise the dimension of the grooves 30 may vary which likewise would depend on the heat load and the application. What is evident from a view of FIG. 1 is that the leading edge is now inundated with openings and not a solid wall of metal. This has the advantage of reducing the heat transfer from the engine's working fluid that is seen by the leading edge and helps to reduce the amount of coolant that would otherwise be required to cool this portion of the blade and hence, is increases the performance of the engine.

Figure 2:
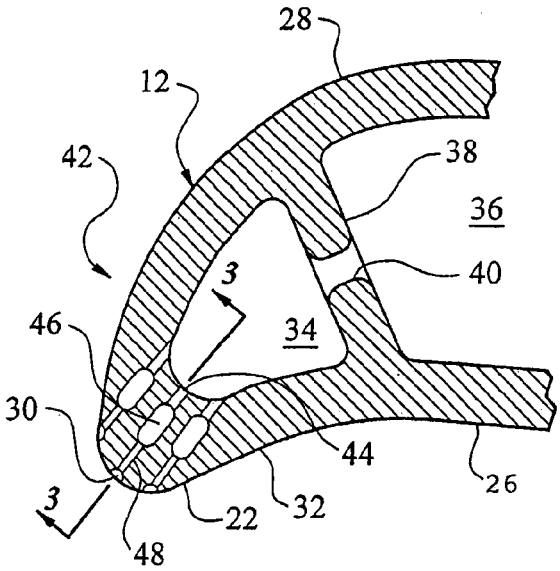
FIG. 2 is a partial sectional view of the leading edge of the airfoil of FIG. 1 taken along lines 2—2 of FIG. 1.
Figure 3:
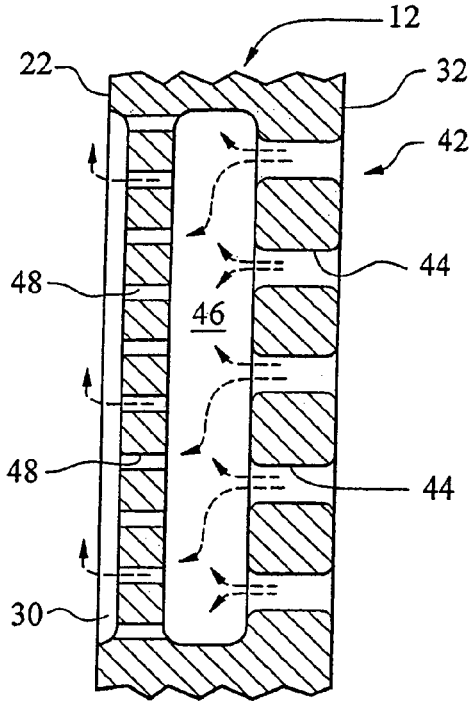
FIG. 3 is a partial sectional view taken along the lines of 3—3 of FIG. 2.

The details of the invention are best seen in FIGS. 2 and 3 where the leading edge includes a wall member 32 defining the leading edge and a portion of the mid-chord cavity 34 and 36. Coolant is supplied to cavity 36 from a passage formed in the bottom of the attachment 14 and as is typical in many turbine cooling installations, the coolant is supplied by the engine's compressor (not shown). A rib 38 separates cavities 34 and 36 and the passage 40 supplies coolant to cavity 34. In accordance with this invention, coolant from cavity 34 flows into the leading edge diffusion cooling system generally indicated by reference numeral 42. While this embodiment illustrates a row of three diffusion passageways leading to the exterior of the leading edge, the number of these passageways is predicated on the particular application of the turbine blade. For the sake of simplicity and convenience the details of only one of the diffusion passageway will be described. As noted from FIG. 2 the diffusion passageway includes a first metering orifice 44 that leads coolant from cavity 34 into plenum chamber 46 and a second metering orifice 48 leads coolant from the plenum chamber 46 to the groove 30 formed in the wall 32 at the leading edge.

In operation, cooling air is supplied through the cavity 34 and metered through the row of metering orifices 44 to impinge onto the airfoil leading edge backside and diffuse the cooling air in the plenum chamber 46. This cooling air is then further metered by virtue of the row of metering orifices 48 and diffused into the groove 30. Groove 30 essentially forms a continuous slot.

Figure 4:
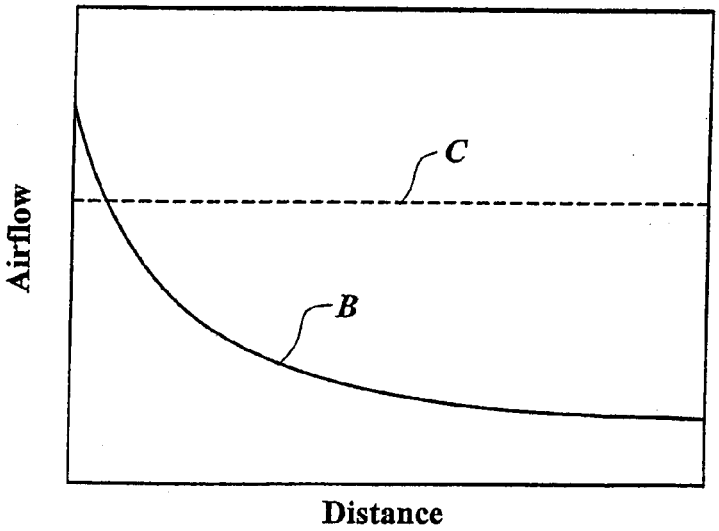
FIG. 4 is a graph illustrating the airflow along the chord-wise expanse of the leading edge.

From the foregoing it is apparent that the flow from the cavity 34 to the groove 30 is diffused by virtue of the pressure drops across metering orifices 44 and 48 and the volume of plenum chamber 46 and groove 30. Not only is the coolant diffused so that it defines an efficacious film of cooling air at the leading edge surface, the sizes of the metering orifices and plenums can be dimensioned so that the airflow spanning the chord-wise direction can be adjusted so that the airflow adjacent to the suction side equals the airflow adjacent to the pressure side. Because of the double usage of cooling air in small individual diffusion portions (plenum 46 and groove 30), this arrangement serves to enhance the airfoil leading edge internal convection capability. This was discussed in the earlier paragraph and is demonstrated by the graph depicted in FIG. 4. The solid line B illustrates how the airflow increases from the pressure side to the suction side because the pressure adjacent the pressure side is higher than the pressure adjacent the suction side and hence, the pressure drops are different resulting in more airflow adjacent toward the suction side. The dash line C represents the airflow when the dimensions of the diffusion passages are sized to accommodate the differences in the outside pressure. As mentioned in the above paragraph, the continuous discrete slots or grooves 30 utilized for the showerhead rows reduce the amount of the hot gas (engine working fluid) surface thus translating to a reduction of airfoil total heat load into the airfoil leading edge region.

What has been shown by this invention is a leading edge cooling system where the usage of cooling air is maximized for a given airfoil inlet gas temperatures and pressures. In addition the coolant is metered twice in each small individual plenum and groove allowing the cooling air to diffuse uniformly into a continuous groove and reduce the cooling air exit momentum. Coolant penetration into the engine fluid working fluid is minimized, yielding good build-up of the coolant sub-boundary layer next to the airfoil surface, resulting in better cooling coverage in the chord-wise and the longitudinal directions. Because this cooling technique utilizes the continuous slot design rather than individual film holes on the airfoil surface, stress concentrations are minimized and a reduction of airfoil total heat load into the airfoil leading edge region is realized. Tailoring the dimension of each of the diffusion passages spanning the chord-wise direction allows the designer to provide a more uniform airflow along this surface. Additionally, the designer can by virtue of this invention size each of the orifices, plenums and grooves so that the airflow adjacent each segment of the airfoil matches the localized heat load, thus, maximizing the usage of airflow and enhancing the performance of the engine.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. Means for cooling the leading edge of an airfoil of a turbine blade comprising a mid-chord passage formed in said airfoil flowing a coolant, a wall defining the leading edge of the airfoil, a plurality of rows and columns of longitudinal extending grooves formed in the outer surface of said wall at the leading edge of said airfoil, each of said grooves fluidly connected to said mid-chord passage for receiving coolant, a plurality of longitudinal spaced orifices formed in said wall connecting said mid-chord passage to a longitudinal plenum formed in said wall, an additional plurality of longitudinal spaced orifices formed in said wall downstream of said plurality of orifices connecting said plenum to said each of said grooves wherein said coolant from said mid-chord passage is diffused before exiting from said airfoil.

2. Means for cooling the leading edge of an airfoil of a turbine blade as claimed in claim 1 wherein each of said plurality of rows are staggered relative to an adjacent row.

3. Means for cooling the leading edge of an airfoil of a turbine blade as claimed in claim 1 wherein each of said plurality of rows are aligned relative to an adjacent row.

4. Means for cooling the leading edge of an airfoil of a turbine blade as claimed in claim 1 wherein each of said plurality of columns are staggered relative to an adjacent row.

5. Means for cooling the leading edge of an airfoil of a turbine blade as claimed in claim 1 wherein each of said plurality of columns are aligned relative to an adjacent row.

6. Means for cooling the leading edge of an airfoil of a turbine blade as claimed in claim 1 wherein the grooves and orifices are sized to control the amount of airflow in each of the grooves so that the airflow spanning the area of the leading edge in a chord-wise direction is relatively constant.

7. Means for cooling the leading edge of an airfoil of a turbine blade as claimed in claim 1 wherein the length of each of said grooves complement the length of each of said plenums.

8. Means for cooling the leading edge of an airfoil of a turbine blade as claimed in claim 1 wherein said rows and said columns of grooves extend from the pressure side to the suction side.

9. A turbine blade having an airfoil, a platform and an attachment comprising a coolant passage formed internally in said blade being fed coolant from the attachment through the platform and into said airfoil, said coolant passage extending longitudinally in said airfoil, a wall defining the leading edge of said airfoil, a plurality of rows and columns of longitudinal extending grooves formed in the outer surface of said wall at the leading edge of said airfoil, each of said grooves fluidly connected to said coolant passage for receiving coolant, a plurality of longitudinal spaced orifices formed in said wall connecting said coolant passage to a longitudinal plenum formed in said wall, an additional plurality of longitudinal spaced orifices formed in said wall downstream of said plurality of orifices connecting said plenum to said each of said grooves wherein said coolant from said coolant passage is diffused before exiting from said wall of said airfoil.

10. A turbine blade as claimed in claim 9 wherein each of said plurality of rows are staggered relative to an adjacent row.

11. A turbine blade as claimed in claim 9 wherein each of said plurality of rows are aligned relative to an adjacent row.

12. A turbine blade as claimed in claim 9 wherein each of said plurality of columns are staggered relative to an adjacent row.

13. A turbine blade as claimed in claim 9 wherein each of said plurality of columns are aligned relative to an adjacent row.

14. A turbine blade as claimed in claim 9 wherein the grooves and orifices are sized to control the amount of airflow in each of the grooves so that the airflow spanning the area of the leading edge in a chord-wise direction is relatively constant.

15. A turbine blade as claimed in claim 9 wherein the length of each of said grooves complement the length of each of said plenums.

16. A turbine blade as claimed in claim 9 wherein said rows and said columns of grooves extend from the pressure side to the suction side.

* * * * *